US005548988A

United States Patent [19]

Proske et al.

[11] Patent Number: 5,548,988

[45] Date of Patent: Aug. 27, 1996

[54] MULTI-STAND ROLL TRAIN

[75] Inventors: Manfred Proske, Mönchengladbach; Gerhard Kulessa, Mülheim, both of Germany

[73] Assignee: Mannesmann Aktiengesellschaft, Duesseldorf, Germany

[21] Appl. No.: 339,769

[22] Filed: Nov. 15, 1994

[30] Foreign Application Priority Data

Nov. 15, 1993 [DE] Germany ..... 43 39 228.8

[51] Int. Cl.[6] ..... B21B 27/02

[52] U.S. Cl. ..... 72/252.5; 492/39

[58] Field of Search ..... 72/208, 209, 235, 72/247, 252.5, 365.2, 366.2, 370; 492/1, 39

[56] References Cited

U.S. PATENT DOCUMENTS 3,392,565 7/1968 Rodder ..... 72/209
4,478,065 10/1984 Gancia et al. ..... 72/239
5,327,762 7/1994 Nagamine et al. ..... 72/247

FOREIGN PATENT DOCUMENTS 1017122 10/1957 Germany .

*Primary Examiner*—Lowell A. Larson
*Assistant Examiner*—Thomas C. Schoeffler
*Attorney, Agent, or Firm*—Cohen, Pontani, Lieberman & Pavane

[57] ABSTRACT

A multi-stand roll train for longitudinally rolling seamless steel tubes in a continuous rolling process around an internal die using integrated two-high stands staggered by 90° with correspondingly grooved rollers. The rollers are radially adjustable relative to one another, and at least the rollers of the final roll stand in the direction of rolling are divided along a central plane which vertically intersects the axis of the roller to form two halves. The two halves of the divided roller are axially adjustable relative to one another.

2 Claims, 4 Drawing Sheets stand n-1 stand n-2 stand n-1 stand n-2

MULTI-STAND ROLL TRAIN

BACKGROUND OF THE INVENTION

1. Field of the Invention

The invention relates to a multi-stand roll train for the longitudinal rolling of seamless steel tubes in a continuous rolling process around an internal die, using integrated two-high stands staggered by 90° with correspondingly grooved rollers, which are radially adjustable relative to one another.

2. Description of the Prior Art

A roll train of this type is known from DE-As 10 17 122. Longitudinal rolling processes having an internal die and a plurality of stands arranged one behind the other as a continuous train have long been known. There have been consistent efforts to reduce the number of roll stands in the continuous train, because a relatively large number of stands represents a considerable investment expense. Over the past two decades it has proved possible to reduce the number of stands from eight to five. Furthermore, suggestions have been made to reduce the number of stands to four or even three.

In all cases, however, it is necessary for the final two stands in the direction of rolling to have a round groove, so that a constant wall thickness can be obtained around the perimeter of the tube. Because differences in the wall thickness around the perimeter would arise if the round groove were adjusted, the prior art produces different wall thicknesses by using mandrels of different diameters.

Using a given mandrel diameter, the desired wall thickness is attained through the radial adjustment of the rollers. However, if the rollers are run together, the thinnest wall will always be rolled at the bottom of the groove, while the wall will remain thicker in the area of the groove sides. Because the two-high stands are staggered by 90°, the result is four thinner and thicker wall areas, each 90° from the next, distributed around the perimeter of the tube.

SUMMARY OF THE INVENTION

Starting from the problem described above and the disadvantages of the prior art, it is an object of the present invention to minimize the number of required mandrel diameters without impairing the wall thickness tolerance around the perimeter of the tube.

Pursuant to this object, and others which will become apparent hereafter, one aspect of the present invention resides in dividing at least the rollers of the final two-high stand in the direction of rolling along their central plane vertically intersecting the axis of roll. The two halves of the divided roller are axially adjustable relative to one another.

The divided construction of the rollers of the final two-high stand allows modulation of the wall thicknesses at the points which, in the stands previously passed through, were rolled more thickly than those areas located at the bottom of the respective roller grooves. The division of the roller into two halves and the axial adjustability of these halves makes it possible to purposefully roll the thicker portions of the wall at four points located 45° from the groove bottom of the roughing pass, and to bring these thicker portions to a wall thickness corresponding to the thinner wall from the previous roll stands. In this way, a corrected tube with good tolerances is obtained, using a minimum number of roll stands and internal dies.

The invention thus allows the graduated sequence of mandrel sizes necessary for the rolling plan to be reduced, because adjusting the rollers of the final roll stand in the radial as well as the axial direction permits the rolling defects from the previous stands to be purposefully rolled down, so that the overall result is a rolling mill requiring a low investment volume.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

FIGS. 1*a* and 2*b* show the roll stand of FIG. 1, in adjusted status;

DETAILED DESCRIPTION OF THE PREFERRED EMBODIMENTS

Figure 1B:
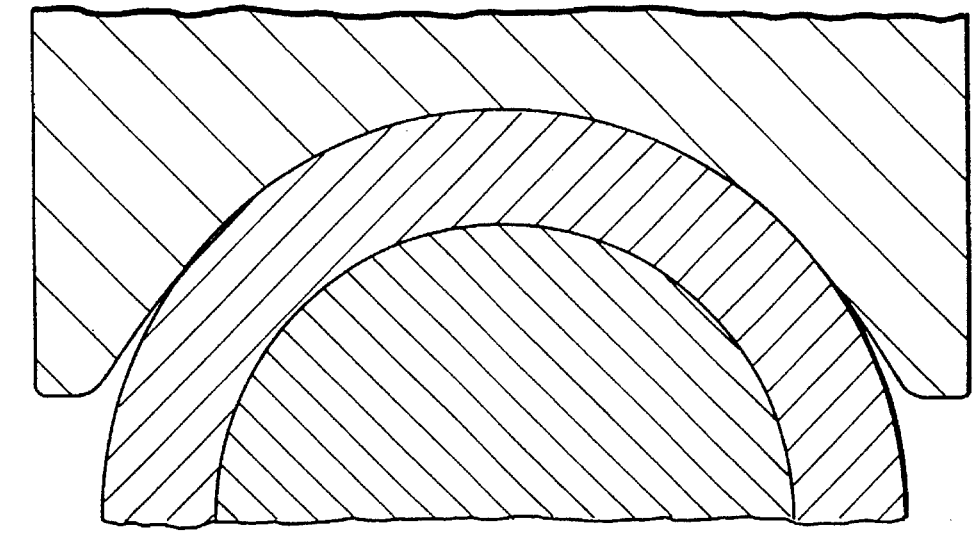
FIGS. 1*a* and 1*b* show a roll stand according to the invention, in non-adjusted status.
Figure 1A:
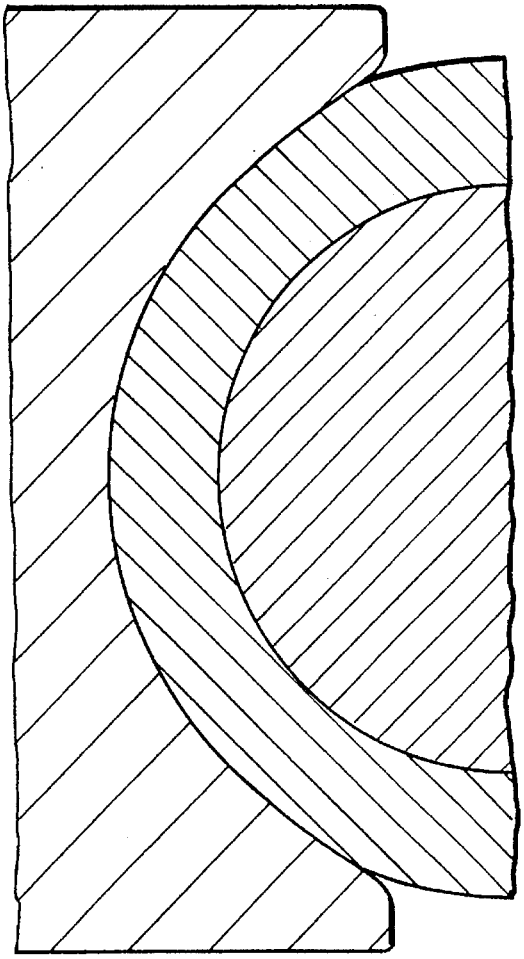

FIGS. 1*a* and 1*b* show the round-grooved roll stands n-2 and n-1 in non-adjusted status, i.e., during rolling of the nominal wall on the depicted mandrel.

Figure 2B:
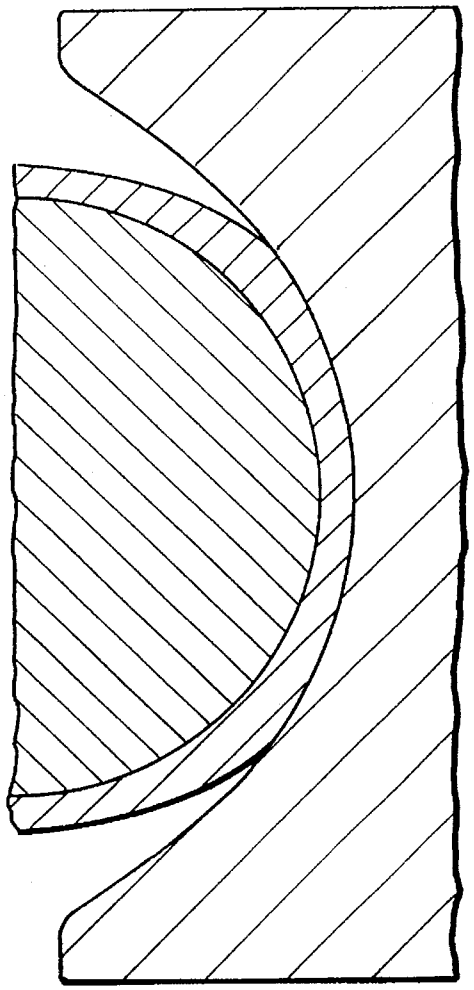
Figure 2A:
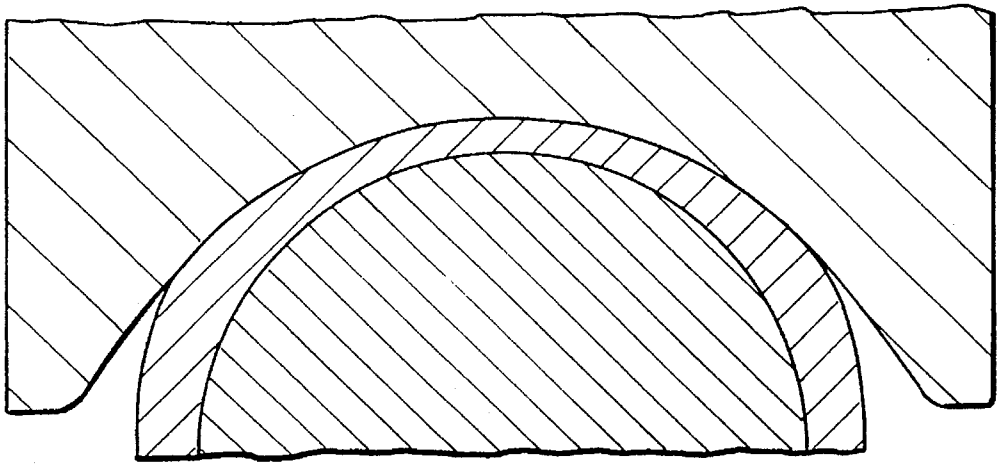

FIGS. 2*a* and 2*b* show the round-grooved roll stands n-1 and n-2 after adjustment, i.e., during rolling of a wall smaller than the nominal wall, for the same depicted mandrel. The differences in wall thickness around the tube perimeter can be observed. The minimum thicknesses occur at the bottom of the groove, while the maximum thicknesses occur 45° from the bottom of the groove.

Figure 3:
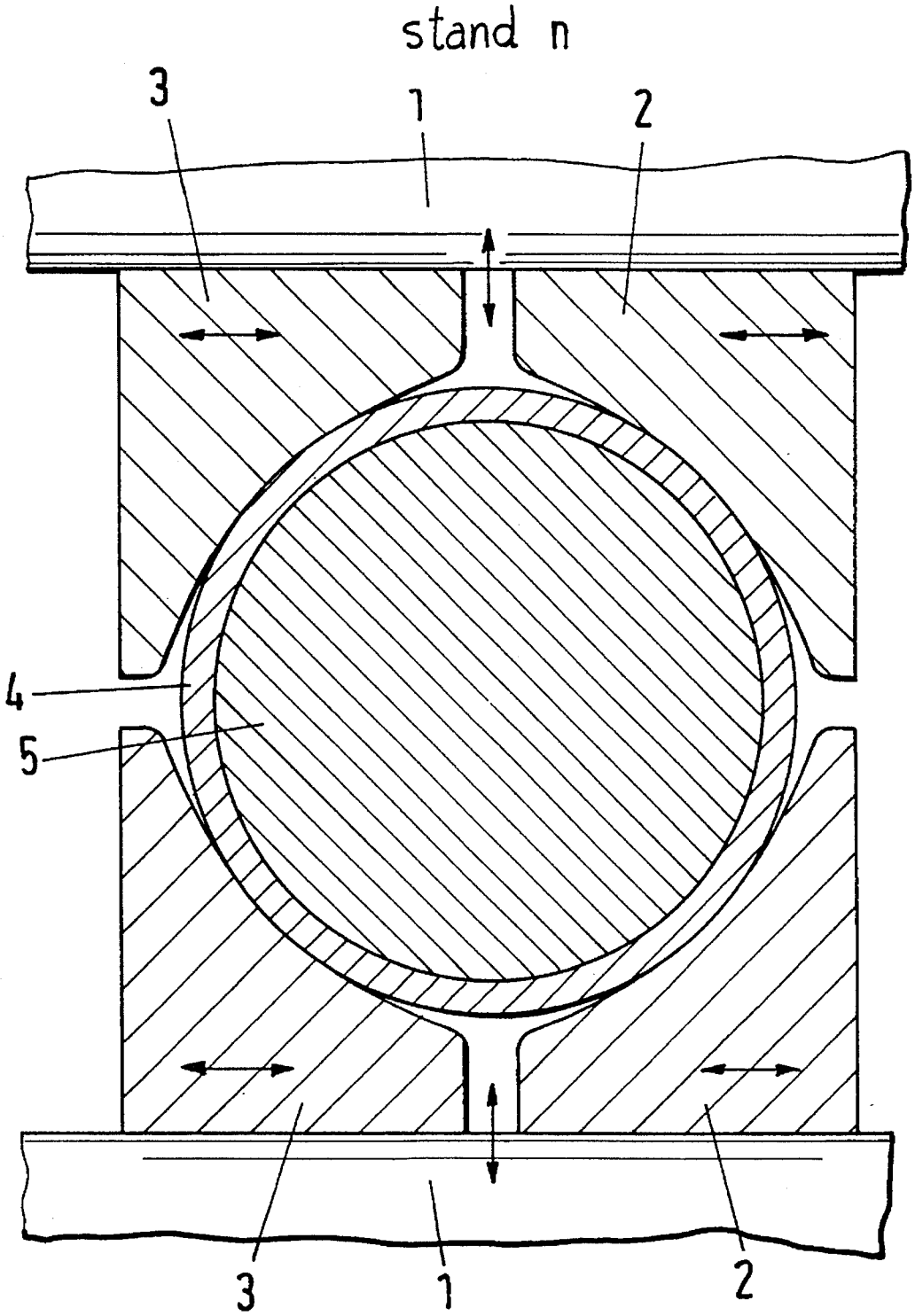
FIG. 3 is a schematic depiction of the groove according to the invention.

In FIG. 3, reference number 1 indicates the axes of the two rollers of the two-high stand on which the two roller halves 2, 3 are located in an axially adjustable fashion. Together with the axes 1 of the two rollers, the two roller halves are also adjustable in the radial direction. Reference number 4 indicates the rolled tube, in the interior of which the internal die is located in the form of a mandrel 5.

FIGS. 2*a* and 2*b*, a tube is rolled with an internal die, i.e., a mandrel 5, having a smaller diameter, then wall thickenings, each of which is located 45° from the bottom of the groove of the two-high pass, will occur at four points on the tube (since the stands are staggered by 90°) during rolling in the passes of the continuous tube train. In the final stand of the continuous train, each of the thicker wall areas enters the groove bottom area of the roller halves 2, 3, where it can be reduced to a wall thickness corresponding to the wall thickness of the groove bottom area from the previous roll stands. The adjustability of the roller halves 2, 3 permits adaptation to different tube sizes using mandrels of given diameters, so that the number of different-sized mandrels which must be provided for the tube plan can be kept to a minimum.

Those skilled in the art will readily know how to carry out the adjustment between the roller halves. Thus, further discussion of the means for adjusting the roller halves will not be provided.

Because the adjustable final stand of the continuous tube train permits the tube to be rounded to a large extent, the rolling mill can function with fewer roll stands and with fewer mandrels, which not only reduces investment costs, but also increases productivity.

Figure 4:
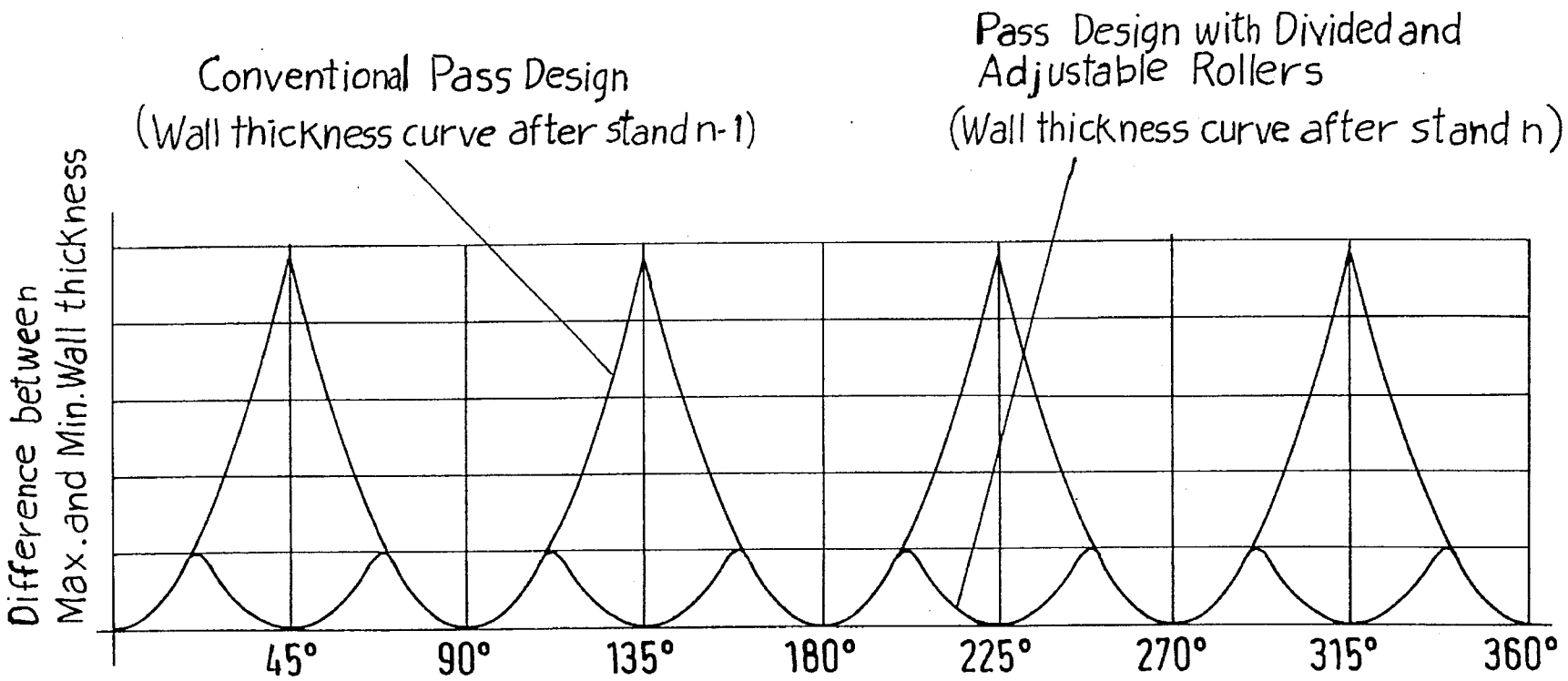
FIG. 4 shows the curve of the wall thickness around the tube perimeter.

FIG. 4 indicates the deviation in wall thickness around the perimeter. The stands n-2 and n-1 are adjusted at the given mandrel diameter and accordingly do not produce a regular wall thickness around the perimeter. The upper curve represents the wall thickness after stand n-1. The lower curve represents the wall thickness after rolling in stand n according to the invention.

The invention is not limited by the embodiments described above which are presented as examples only but can be modified in various ways within the scope of protection defined by the appended patent claims.

We claim:

1. A multi-stand roll train for longitudinally rolling seamless steel tubes in a continuous rolling process around an internal die, comprising a plurality of integrated two-high stands staggered by 90° with correspondingly grooved rollers adapted to be radially adjustable relative to one another, each of the rollers having an axis, at least the rollers of a final one of the roll stands in a direction of rolling being divided along a central plane which perpendicularly intersects the axes of the rollers to separate each of the rollers into two halves, the two halves being adapted to be axially adjustable relative to one another.

2. A multi-stand roll train as defined in claim 1, and further comprising means for adjusting the roller halves relative to one another.

* * * * *